US006382425B1

(12) United States Patent
Brickner et al.

(10) Patent No.: US 6,382,425 B1
(45) Date of Patent: May 7, 2002

(54) MOBILE SYSTEM FOR RECOVERING MATERIAL FROM CONSTRUCTION WASTE AND DEMOLITION DEBRIS

(76) Inventors: Robert H. Brickner, 9732 S. Park Cir., Fairfax Station, VA (US) 22032; Steven Clements, 505 Dale Ave., McHenry, IL (US) 60050

( * ) Notice: Subject to any disclaimer, the term of this patent is extended or adjusted under 35 U.S.C. 154(b) by 0 days.

(21) Appl. No.: 09/539,440

(22) Filed: Mar. 30, 2000

Related U.S. Application Data

(60) Provisional application No. 60/127,004, filed on Mar. 31, 1999.

(51) Int. Cl.[7] ..... B07B 1/49

(52) U.S. Cl. ..... 209/421; 209/659; 209/12.1; 209/420; 209/930; 209/672; 209/702; 209/705

(58) Field of Search ..... 209/659, 12.1, 209/629, 630, 421, 420, 930

(56) References Cited

U.S. PATENT DOCUMENTS

| | | | | |
|---|---|---|---|---|
| 4,383,651 A | | 5/1983 | Couperus | |
| 4,598,875 A | | 7/1986 | Bronson et al. | |
| 4,771,953 A | | 9/1988 | Morey | |
| 5,100,537 A | * | 3/1992 | Krause | 209/2 |
| 5,411,147 A | * | 5/1995 | Bond | 209/44.4 |
| 5,645,234 A | | 7/1997 | Del Zotto | |
| 5,647,545 A | | 7/1997 | Conner | |
| 5,819,950 A | * | 10/1998 | McCloskey | 209/241 |

FOREIGN PATENT DOCUMENTS

JP 406101354 A * 4/1994

OTHER PUBLICATIONS

Erin Systems, Inc., Innovative C&D System from Erin (2 pages).

Ptarmigan Machinery Co., advertising brochures (12 pages).

* cited by examiner

*Primary Examiner*—Donald P. Walsh
*Assistant Examiner*—Jonathan R Miller
(74) *Attorney, Agent, or Firm*—Finnegan, Henderson, Farabow, Garrett & Dunner, L.L.P.

(57) ABSTRACT

A mobile system for recovering materials from construction waste or demolition debris is provided. The system includes a mobile wheeled chassis that has at least one picking station. A grapple is mounted on the wheeled chassis for selectively retrieving waste or debris from a jobsite. A screen is disposed on the wheeled chassis and is configured to receive the waste or debris from the grapple. The screen sorts the waste or debris into fines and oversized material. A conveyor transports the oversized material adjacent to at least one picking station to allow selected materials to be removed for further processing.

22 Claims, 6 Drawing Sheets

MOBILE SYSTEM FOR RECOVERING MATERIAL FROM CONSTRUCTION WASTE AND DEMOLITION DEBRIS

CROSS REFERENCE TO RELATED APPLICATION(S)

This application claims priority rights under 35 U.S.C. §119(e)(1) based on provisional U.S. Patent Application No. 60/127,004 filed on Mar. 31, 1999.

BACKGROUND OF THE INVENTION

This invention generally relates to a system for processing construction waste and demolition debris. More particularly, the present invention relates to a mobile system for recovering useful material from construction waste or demolition debris.

In February 1988, the United States Environmental Protection Agency (EPA) created a Municipal Solid Waste Task Force to fashion a strategy for improving the nation's management of municipal solid waste (MSW). One of the task force's objectives was to increase the use of source reduction and recycling programs to reduce landfilling of solid waste. In a February 1989 report, the EPA outlined the framework necessary to achieve the task force's goal of managing 25% of our nation's MSW through source reduction and recycling and, ultimately, through an integrated solid waste management system. In the early 1990's, many state legislatures set 1995 as their benchmark year for meeting these recycling and waste management goals. However, as of 1994, only 23 of the 50 states were including construction and demolition (C&D) debris and waste in their recycling rates.

As of 1998, several states have amended their regulations to include both MSW and C&D debris in their new planning guidelines and waste disposal facility reporting. Many states have now incorporated C&D quantities and their associated recovery and recycling into their formal statewide planning reports. In June 1998, the EPA published a long overdue report titled "Characterization of Building-Related Construction and Demolition Debris in the Unites States." The purpose of this report was to characterize the quantity and the composition of building-related C&D debris and to summarize the waste management practices for this type of waste. The authors of this report estimate that in 1996, an estimated 136 million tons of building-related C&D debris were generated in the United States. Of this amount, 70–80 percent of the C&D debris was disposed in landfills and only 20–30 percent of the debris was recovered for recycling.

It is well known in the recycling industry that the recovered materials markets are the key to the economic survival of recycling programs. If the recovered materials are dirty or contain contaminants and do not meet certain minimum quality standards, the buyers of the materials will lower the prices paid and/or terminate the purchase agreements altogether. To perpetuate the recovered materials markets, then, it is necessary to generate clean, high-quality recovered materials. The current trend in solid waste recovery systems is to incorporate a combination of mechanical devices and manual labor to obtain the clean, high quality material. This approach provides the necessary high-grading (product quality improvement) of the mixed waste materials and allows the materials to be sorted into discreet classifications of constituents (e.g. newspaper, ferrous and aluminum cans, HDPE plastic bottles (milk jugs), PET plastic bottles (soda bottles), etc.).

In the systems that combine mechanical devices with manual labor, the mechanical devices are utilized to create a stream of waste for economy-of-size processing. The manual labor is used for discreet identification and removal of marketable materials from the mixed waste stream. In typical operation, the waste stream is conveyed on a conveyor belt while the manual labor analyzes the material in the waste stream and identifies and removes selected items for further processing, such as recycling or reuse.

Within the United States waste industry, the processing and recovery of C&D waste materials has tended to be a stepchild to the interests of MSW materials. However, as the interest in achieving higher recycling rates and extending the life of existing landfills grows, so does the interest in exploring new options for recovery and recycling of C&D waste.

Several devices currently are being marketed for the processing of C&D waste and debris. These devices tend to be single feedstock processing units, e.g. concrete crushers, wood tub-grinders, rotary or flat bed screens for sizing single-source or mixed materials, and the like. These devices may be stationary as well as portable. In operation, these units are typically transported to the field and combined with other units to form a larger processing system. Typically three to five different large mechanical devices are transported to a field site for C&D operations that may last anywhere from a few weeks to a few years. "Mobile" units are preferable to "stationary" units due to certain permitting/licensing, marketing, and tax benefits that exist for mobile systems.

In light of the foregoing, there is a need for a self-contained, mobile system for recovering useful material from construction waste or demolition debris.

SUMMARY OF THE INVENTION

Accordingly, the present invention is directed to a mobile system for recovering materials from construction waste or demolition debris that preferably obviates one or more of the limitations and disadvantages of prior art construction waste and demolition debris recovery systems. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a mobile system for recovering materials from construction waste or demolition debris. The system includes a mobile wheeled chassis that has at least one picking station. A grapple is mounted on the wheeled chassis for selectively retrieving waste or debris from a jobsite. A screen is disposed on the wheeled chassis and is configured to receive waste or debris from the grapple. The screen sorts the waste or debris into fines and oversized material. There is provided a conveyor that transports the oversized material adjacent to the at least one picking station to allow selected materials to be removed for further processing.

In another aspect, the invention is directed to a mobile system for recovering materials from construction waste or demolition debris. The system includes a mobile wheeled chassis that has at least one picking station. A loading means for selectively retrieving waste or debris from a construction site is disposed on the wheeled chassis.

A sorting means is also disposed on the wheeled chassis and is configured to sort the waste or debris into fines and oversized material. A conveying means is provided for transporting the oversized material adjacent to at least one picking station to allow selected materials to be removed for further processing.

In yet another aspect, the present invention is directed to a method of recovering materials from construction waste or demolition debris. The method includes loading selected construction waste or demolition debris onto a screen disposed on a mobile wheeled chassis. The waste or debris is sorted into fines and oversized material. The oversized material is conveyed adjacent to at least one picking station and selected recoverable materials are removed from the oversized material for further processing.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate the preferred embodiments of the present invention and together with the description, serve to explain the principles of the invention. In the drawings.

DETAILED DESCRIPTION

Reference will now be made in detail to the presently preferred embodiments of the present invention, examples of which are illustrated in the accompanying drawings. Wherever possible, the same reference numbers will be used throughout the drawings to refer to the same or like parts. An exemplary embodiment of a mobile system for recovering material from construction waste or demolition debris according to the present invention is shown in FIG. 1 and is designated generally by reference number 20.

In accordance with the present invention, there is provided a mobile system for recovering material from construction waste or demolition debris. The system includes a mobile wheeled chassis. Preferably, the wheeled chassis is configured to be easily connected to a truck or other vehicle capable of transporting the recovery system to a jobsite. As used herein, the term "jobsite" includes any location, such as, for example, construction sites or demolition locations, where construction waste or demolition debris is generated. The jobsite may also be a location that is removed from the actual construction or demolition site, for example, a site where the construction waste and demolition debris can be transported for processing and recovery of materials for recycling.

Figure 1:
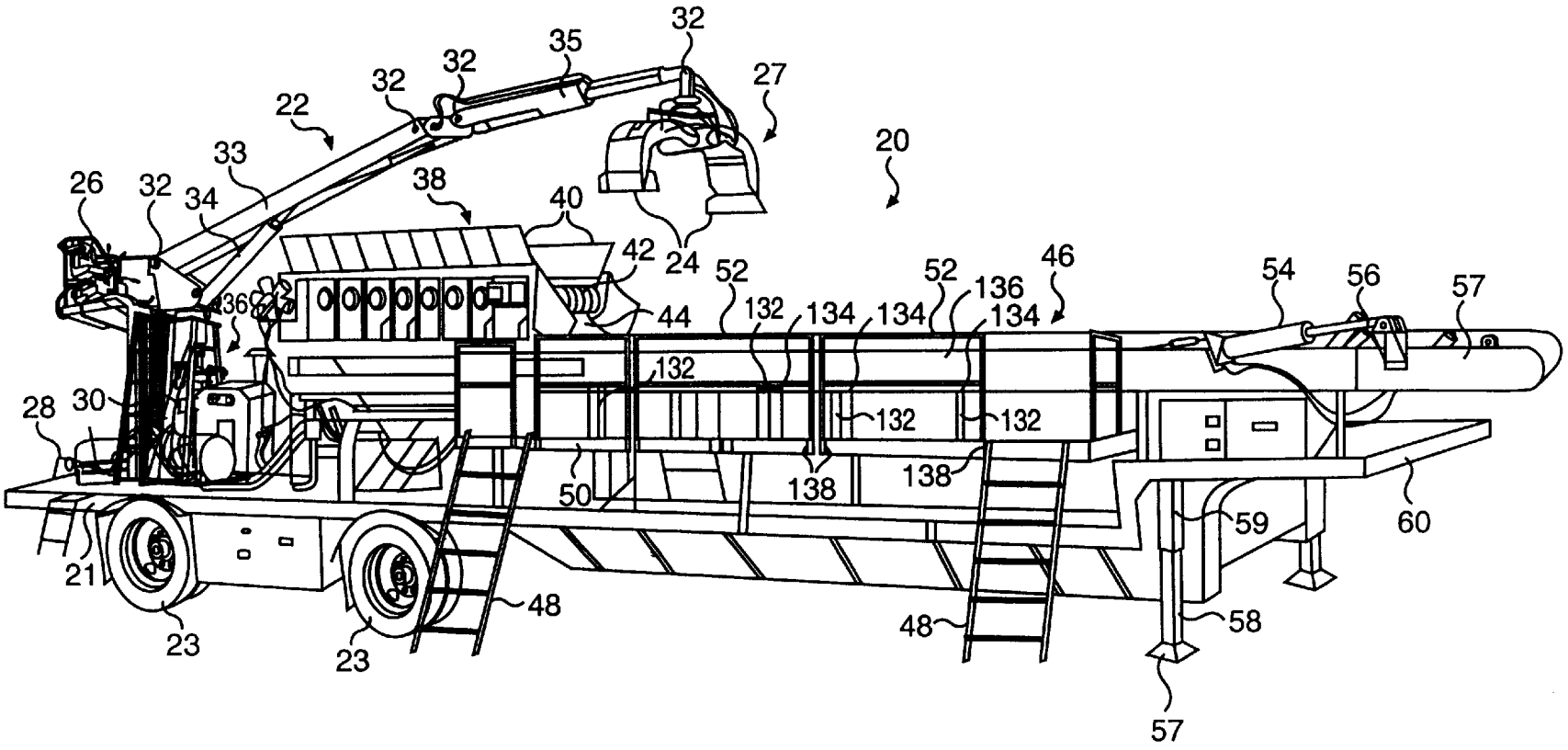
FIG. 1 is a perspective view of a mobile construction waste and demolition debris recovery system according to the present invention.

As illustrated in FIG. 1, a mobile construction waste and demolition debris recovery system 20 includes a mobile wheeled chassis 21. Preferably, chassis 21 has a set of wheels 23 at one end, although the present invention could have the wheels disposed at any location relative to the chassis, provided that they adequately support the chassis. In the preferred embodiment, chassis 21 is configured in the form of a trailer capable of being towed by a tractor or truck. A trailer hitch 60 and a retractable support 58 are preferably provided on chassis 21. Trailer hitch 60 may be of any configuration, including a $5^{th}$ wheel, recognized in the art as capable of attaching to a truck, tractor, or other transport vehicle. Alternatively, the system could be transported in a number of other ways such as automobile road, railroad, etc. For example, chassis 21 could be part of a railroad car or part of a truck rather than merely being a trailer pulled by a truck.

Retractable support 58, sometimes called a landing gear, is moveable between a transport position and an operational position (illustrated in FIG. 1). In the transport position, a sleeve 59 receives and locks the retractable support 58 in a position where the foot 57 of support 58 is lifted from the ground. In the operational position, retractable support 58 is locked to sleeve 59 such that support 58 extends from sleeve 59 to engage the ground and provide support for wheeled chassis 21 to keep the wheeled chassis in a substantially horizontal position. Preferably, support 58 is adjustable and may be locked in different positions with respect to sleeve 59 to account for varying terrain at a jobsite. In addition, a jack (not shown), or other similar mechanism, may be included to adjust the position of support 58 relative to sleeve 59.

In accordance with the present invention, a grapple is mounted on the wheeled chassis. The grapple is operable to selectively retrieve construction waste or demolition debris from a jobsite. The present invention contemplates that other loading means, such as, for example, a wheeled front end loader with bucket, a track-excavator with bucket, or bucket with thumb, may be included in the recovery system to retrieve waste or debris or move the waste and debris closer to the wheeled chassis. In addition, a separate loading device, such as a front end loader or bucket excavator, may be used in conjunction with the disclosed recovery system to stage debris and waste for retrieval by the loading means. The separate loading device may also be used to load the waste and debris onto the screen if the grapple is inoperable.

As illustrated in FIG. 1, a grapple 22 is positioned at one end of wheeled chassis 21. Preferably, grapple 22 is positioned directly over one set of wheels 23 to provide support for the grapple. Grapple 22 includes a bucket 27 having a pair of tongs 24. Tongs 24 are moveable between an open position and a closed position.

Bucket 27 of grapple 22 is mounted on support arms 33 and 35. Preferably, a series of hinges 32 connect support arms 33 and 35 with bucket 27. The connections are configured to provide a wide range of motion of the grapple bucket 27. In the illustrated embodiment, grapple 22 includes hydraulic cylinders 34 that actuate support arms 33 and 35 and the movement of the grapple bucket 27.

As shown in FIG. 1, preferably, a power supply 36 is provided on wheeled chassis 21 to provide power for the grapple 22 and all motors driving the moving equipment. The present invention contemplates, however, that the recovery system 20 may be connected to auxiliary power supply, such as a power source provided at the jobsite.

Figure 2:
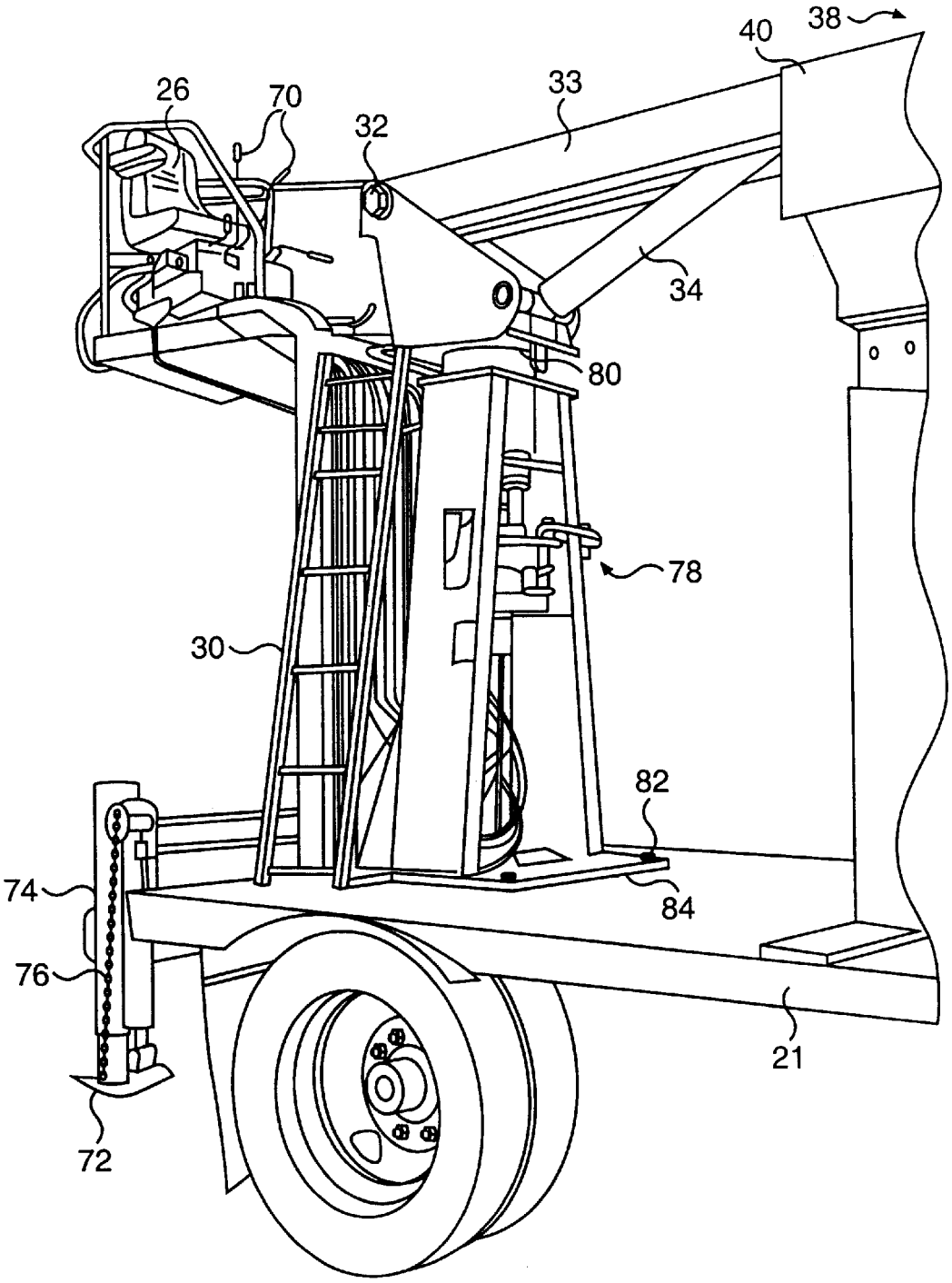
FIG. 2 is a perspective view of an operator station for a grapple mounted on a mobile wheeled chassis in accordance with the present invention.

As illustrated in FIG. 2, a support frame 78 connects grapple 22 to wheeled chassis 21 and provides support for support arm 33 of grapple 22. Support frame includes a base plate 84 that has holes configured to receive bolts 82 or any other connecting device to attach base plate 84 and support frame 78 to wheeled chassis 21.

Preferably, a retractable grapple support 72 is disposed on both sides of the rear of wheeled chassis 21 to act as a stabilizer. A chain 76 is provided to hold retractable grapple support 72 in a retracted position, where the support 72 is held within sleeve 74. Prior to operation, chain 76 is removed and grapple support 72 is extended from and locked with respect to sleeve 74 to engage the ground. In this manner, the retractable grapple support 72 provides additional support and stabilization for the grapple during operation.

As illustrated in FIG. 2, the recovery system 20 includes an operator's chair 26. Operator's chair 26 is preferably elevated, with respect to wheeled chassis 21, to provide the operator with a commanding view of the job site. This elevation aids the operator in selecting construction waste and demolition debris from the jobsite to be processed and for removing waste and debris that is not recoverable or is too bulky for processing. Preferably, a ladder 30 attaches to support frame 78 to provide access to the operator's chair 26.

Controls 70 for grapple 22 are disposed proximate operator's chair 26. Controls 70 allow the operator to guide the grapple through a wide range of motion to selectively retrieve waste and debris for recovery processing. In the illustrated embodiment, controls are in the form of foot pedals and hand-activated levers and switches, although any type of controls, including remote controls, such as a joystick package located, for example, on an operator's belt, may be used. The present invention also contemplates that the grapple may be programmed to move through a predefined sequence motion.

A swivel joint 80 connects support frame 78 with grapple arm 33. Swivel joint 80 allows grapple arm 33 and, thus, grapple bucket 27 (referring to FIG. 1) to swivel through a wide range of motion. Preferably, swivel joint 80 allows grapple 22 to swivel through approximately 2700 of motion relative to chassis 21. In the illustrated embodiment, the range of motion is limited by the location of the operator controls and hydraulic line linkages. It is contemplated that the grapple controls and hydraulic line may be located elsewhere on the system to provide for a greater range of swiveling motion of the grapple bucket.

The above described grapple configuration is designed to provide a great range of motion for the grapple bucket. Preferably, the grapple bucket is easily moved in three directions relative to the wheeled chassis. This configuration provides flexibility for the operator to select the type of construction waste or debris retrieved from the jobsite for processing and recovery.

As illustrated in FIG. 2, grapple arm 33 may also be moved into a transport position. In the transport position, grapple arm 33 pivots with respect to joint 32 to allow the grapple to lower into a substantially horizontal position and to rest against the screen or conveyor (described in greater detail below) of the recovery system. Preferable, when the grapple is lowered into the transport position, the grapple arm and bucket are secured with a grapple gallows fixed to the recovery system to prevent the grapple from being damaged during transport.

In accordance with the present invention, a screen is disposed on the wheeled chassis. The screen is configured to receive the construction waste or demolition debris selected by the operator and loaded into the grapple. The screen sorts the debris into fines and oversized material. In the illustrated embodiment, the screen is a disc screen. The present invention contemplates however, that other sorting means, such as, for example, vibrating feeders, finger screens, or trommel screens, may be used with the recovery system.

As illustrated in FIG. 1, a screen 38 is positioned on wheeled chassis 21, preferably in relative close proximity to grapple 22. This location of screen 38 allows the grapple operator to select construction waste or demolition debris to be processed from the jobsite and feed the material onto the screen. Preferably, screen 38 includes side walls 40 that help guide the selected material onto the screen.

Figure 3:
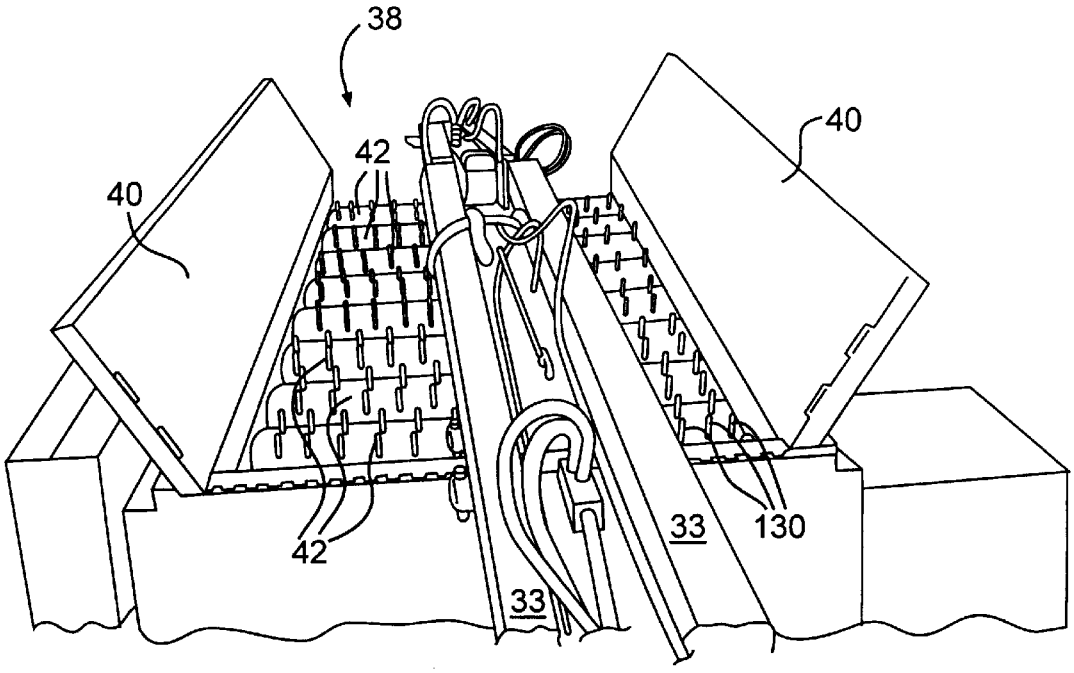
FIG. 3 is a perspective view of a screen and a grapple according to the present invention, illustrating the grapple in the transport position.

As illustrated in FIG. 3, screen 38 is preferably comprised of a series of discs 42. Each disc includes a plurality of knuckle-like projections 130. Each disc 42 is separated from the next by a certain distance. In operation, a motor 108 (shown in FIG. 6), through a series of drive chains, rotates the series of discs 42, thereby causing projections 130 to spin.

As the grapple places material onto screen 38, the rotating projections 130 contact the material to move the material from disc 42 to disc 42. Smaller material, such as dirt, rocks, and other unprocessable material, that is small enough to fit through the openings between discs 42 will filter through the screen, leaving only the larger, oversized recoverable material on the screen for further processing. Thus, the screen will sort out smaller material, such as dirt, rocks and other contaminants to provide a cleaner stream of larger, recoverable material to continue on for further processing.

Figure 4:
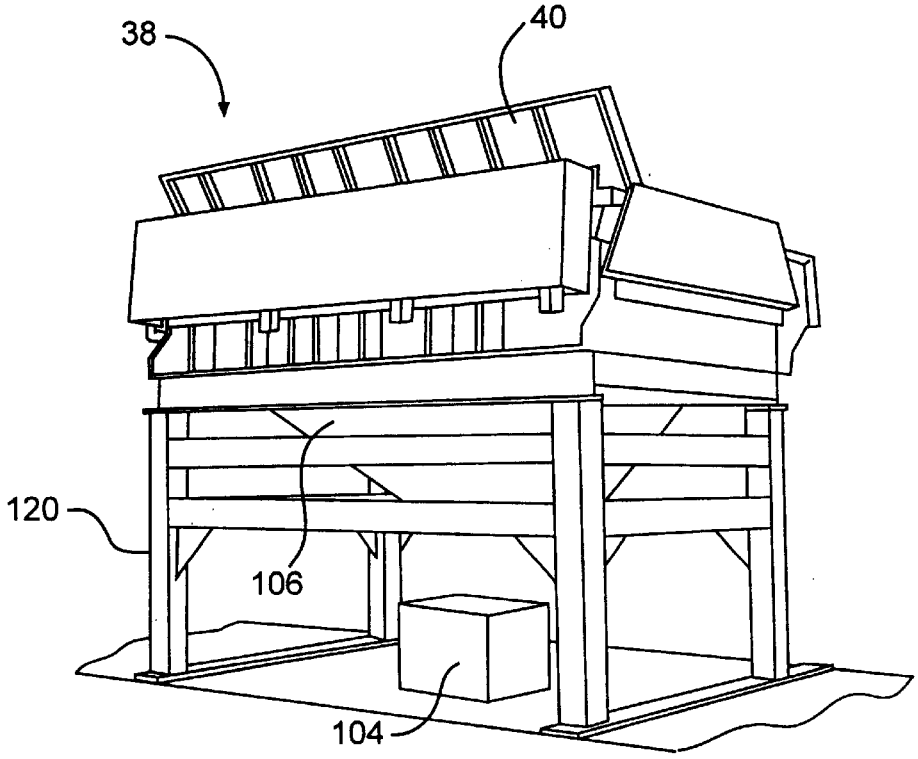
FIG. 4 is a perspective view of a screen and a bin for catching fines in accordance with the present invention.
Figure 5:
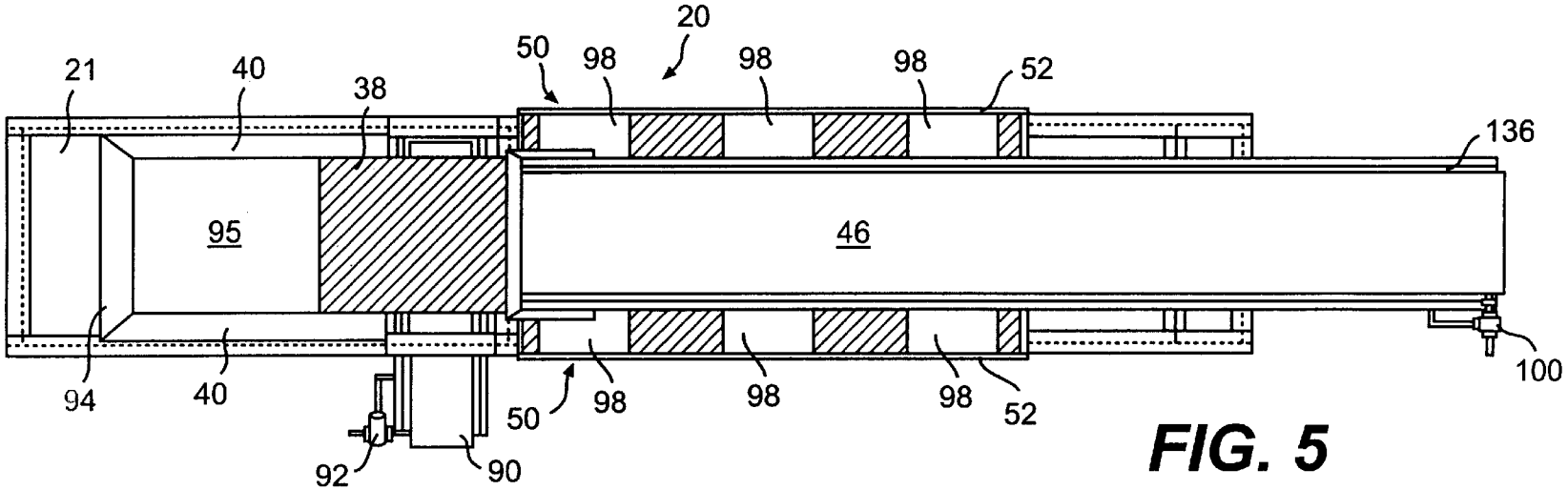
FIG. 5 is top view of a screen and conveyor for sorting and transporting construction waste and demolition debris in accordance with the present invention.
Figure 6:
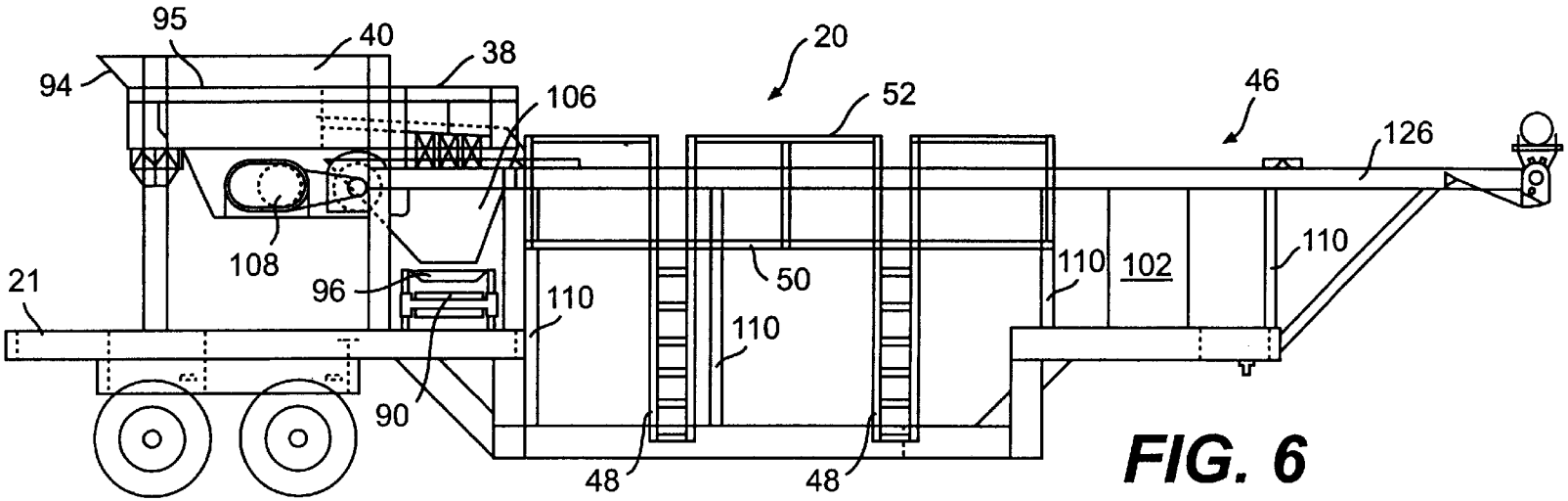
FIG. 6 is a side view of the screen and conveyor of FIG. 3.

As shown in FIG. 4, screen 38 is mounted on a support structure 120. Preferably the support structure 120 elevates screen 38 with respect to wheeled chassis 21. A chute 106 is positioned below screen 38 to guide the smaller material that falls from screen 38. As illustrated in FIGS. 5 and 6, chute 106 guides the smaller material onto a fines conveyor 90. A motor 92 is connected to fines conveyor 90 to move the conveyor and thereby transport the fine material to one side of wheeled chassis 21. The fine material falls from the fines conveyor 90 into a separate bin or vehicle (not shown) to be transported away from the jobsite. Preferably, a second chute 96 is positioned between chute 106 and fines conveyor 90 to further guide the fine material onto the fines conveyor belt.

Alternatively, a bin 104 (shown in FIG. 4) may be positioned below chute 106. In this alternative configuration, chute 106 guides fine material passing through screen 38 into bin 104. Preferably, bin 104 is easily removable from wheeled chassis 21 to allow the fine material to be dumped into a dumpster or elsewhere.

In an alternative embodiment illustrated in FIGS. 5 and 6, recovery system 20 includes a feeder 95 integral with the screen. Feeder 95 is bounded on three sides by slanted guide walls 40 and 94, which are configured to guide material dropped by grapple 22 along feeder 95 and onto screen 38. Feeder 95 may be slanted or include a mechanical device such as, for example a conveyor belt or vibrating bed, to move material towards screen 38.

In accordance with the present invention, the mobile construction waste and demolition debris recovery system includes a conveyor to transport the oversized material from the screen past at least one picking station. Preferably, the conveyor is a belt conveyor of a sliding belt variety, although the present invention contemplates the use of alternative conveyors. The picking station is configured to allow a laborer to select certain recoverable materials from the conveyor.

As illustrated in FIG. 1, a conveyor 46 is positioned adjacent screen 38. Conveyor 46 includes a belt that moves lengthwise along wheeled chassis 21. A chute 44 guides oversized material exiting screen 38 onto conveyor belt 46. Conveyor belt 46 transports the material along wheeled chassis 21. Preferably, conveyor belt 46 is powered by power source 36 provided on recovery system 20, although a separate source of power may also be used.

Referring to FIG. 5, platforms 50 are positioned on both sides of conveyor 46. Each platform 50 defines a series of picking stations 98. In the illustrated embodiment, each platform 50 defines three picking stations 98, although other numbers of picking stations may be provided. Each picking station 98 is preferably configured to accommodate at least one laborer assigned to remove selected material from the conveyor 46.

Preferably, a series of material receptacles (not shown) or chutes are positioned next to each picking station 98. As recoverable material passes by each picking station 98, the laborer at the station examines the passing material and retrieves any valuable material. Each laborer may be responsible for removing a certain type of material and placing that material into a designated chute or receptacle. In this manner, the recoverable material can be separated into distinct classifications for recovery and recycling purposes. As an alternative to the material chutes, a series of portable receptacles may be located adjacent each picking station for the laborers to place the recovered materials. These receptacles may also be at grade for aggregation of larger materials.

The speed at which the conveyor 46 runs is governed by the picking rate of the laborers and is dependent upon rate at which the waste and debris is loaded onto the screen 38 and the type of material being loaded. Preferably, the screen speed is adjustable to change the rate at which material is fed onto conveyor 46 and the conveyor speed is adjustable to change the rate of conveyor movement. The operating speed of each device may be adjusted independently, depending upon the particular operating conditions.

Figure 7:
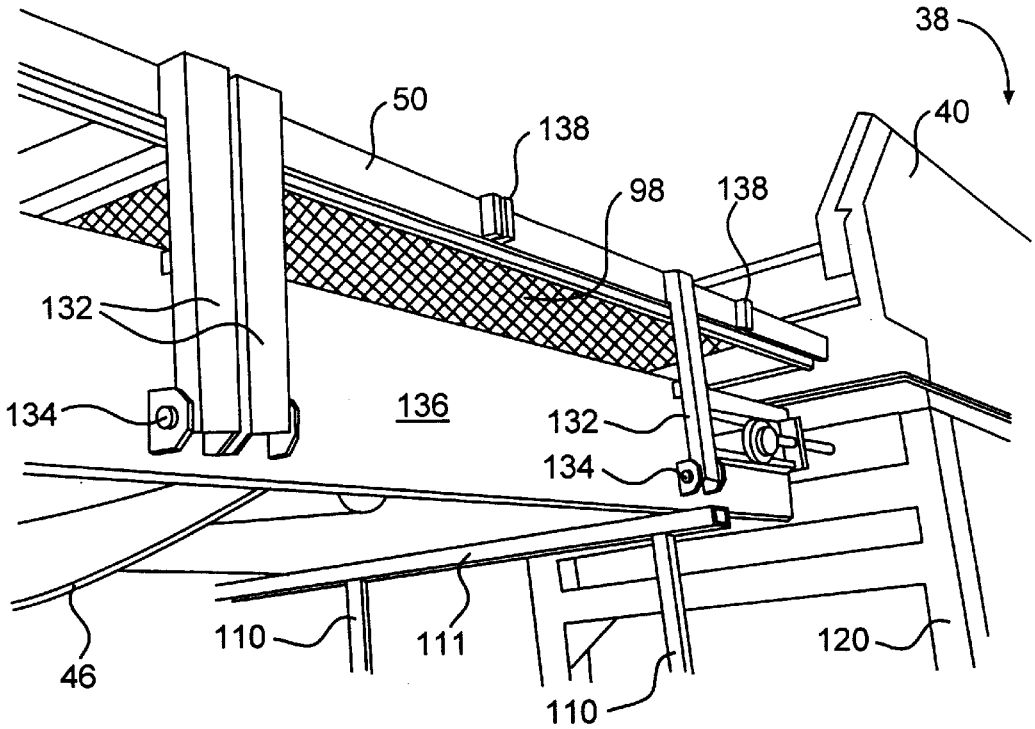
FIG. 7 is a perspective view of a picking station platform according to the present invention, illustrating the platform in a transport position.

A series of struts 132, shown in FIGS. 1 and 7, connect each platform 50 to wheeled chassis 21. A respective hinge 134 is disposed between each sidewall 136 of the conveyor 46 and each strut 132. Hinges 134 allow each platform 50 to be rotated with respect to the conveyor 46. As shown in FIG. 7, hinges 134 allow each platform 50 to be swung over top of conveyor 46 into a transport position. In this manner, platforms 50 may be retracted to allow recovery system 20 to be easily transported between jobsites. Preferably, the platforms are secured to the conveyor 46 prior to transporting the system to prevent the platforms from moving during transport.

Referring again to FIG. 1, a series of railings 52 are positioned along the perimeter of each platform 50. Preferably, railings 52 are engaged with platforms 50 in a manner that allows railings 52 to be securely held while allowing the railings 52 to be easily removed from the platforms 50. This may be accomplished by providing a bracket 138 on each platform 50 that is configured to slidingly receive the posts of railings 52. The weight of railing 52 will ensure that the railings 52 remain engaged with the brackets 138. Additionally, a securing mechanism (not shown) such as a bolt or pin maybe disposed in each bracket 138 to hold the railings 52 in place. The railings 52 may be engaged with the brackets 138 when the recovery system is in position at a jobsite and removed when work is completed at the jobsite.

Preferably, railings 52 surround substantially the entire outer perimeter of each platform 50 to prevent a laborer from accidently slipping and falling from platforms 50. Openings are provided in the railings to allow laborers access to the picking stations. In addition, one or more ladders 48 may be provided to allow easier access to the picking stations.

Figure 8:
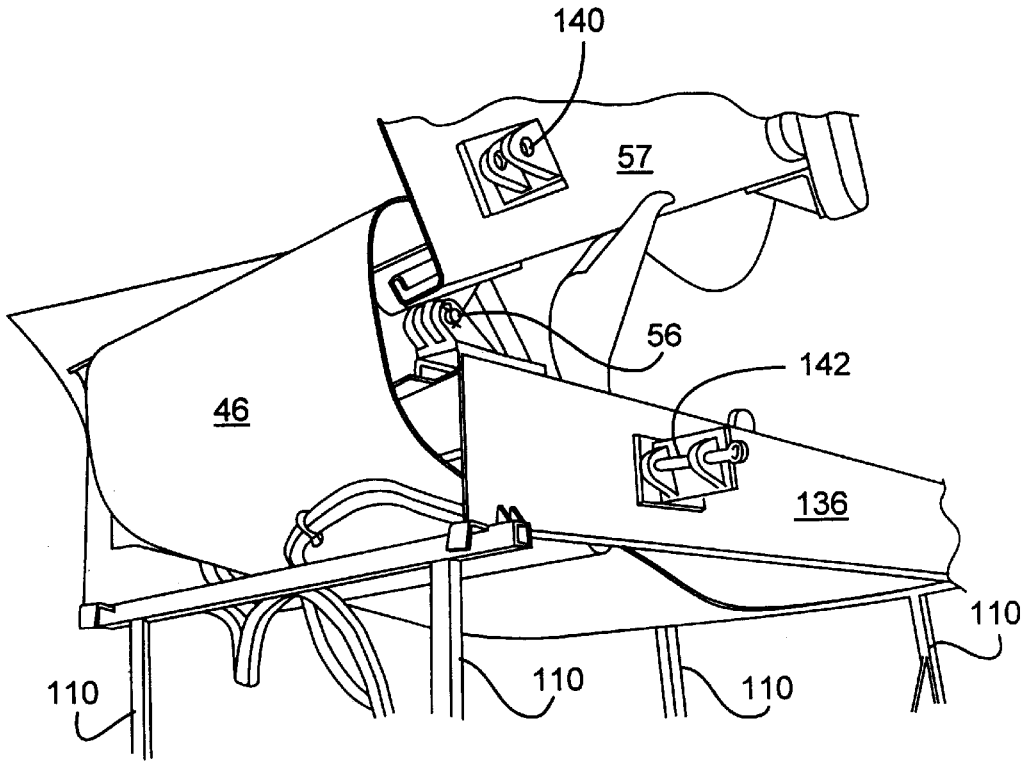
FIG. 8 is a perspective view of a conveyor in accordance with the present invention, illustrating the conveyor in a transport position.

As illustrated in FIG. 8, one end of conveyer 46 preferably includes a hinge 56. Hinge 56 defines a moveable end 57 of the conveyor 46 that may be pivoted with respect to the remainder of the conveyor 46. Thus, as illustrated in FIG. 8, when conveyor 46 is not operating, moveable end 57 of conveyor 46 may be pivoted into a transport position, where moveable end 57 is positioned over the remainder of the conveyor 46. Preferably, a locking pin 142 and corresponding receptacle 140 are provided, such that the moveable end 57 may be locked to the remainder of the conveyor 46 when the conveyor 46 is operational. In addition, an additional securing mechanism (not shown) may be used to secure the moveable end 57 of the conveyor 46 to the remainder of the conveyor 46 when the recovery system is being transported. By including the hinged end of the conveyor 46, the total operational length of the conveyor 46 may be extended without increasing the size of the chassis. This will maximize the number of picking stations that may be included on the system to maximize the effectiveness of the material recovery effort and allow the non-recovered materials that remain on the conveyor 46 to drop into a pile or, preferably, into a container for ultimate disposal.

In addition, a magnetic separator (not shown) may be used with the recovery system of the present invention. The magnetic separator may be positioned at any point along the conveyor to separate ferrous materials from non-ferrous material. Preferably, the magnetic separator is a rotating deck located above the conveyor 46 at the end of conveyor 46. The ferrous material will attach to the rotating deck of the magnet, whereas the non-ferrous material will stay on conveyor 46. In this manner, the ferrous material may be separated from the non-ferrous material for further processing.

Figure 9:
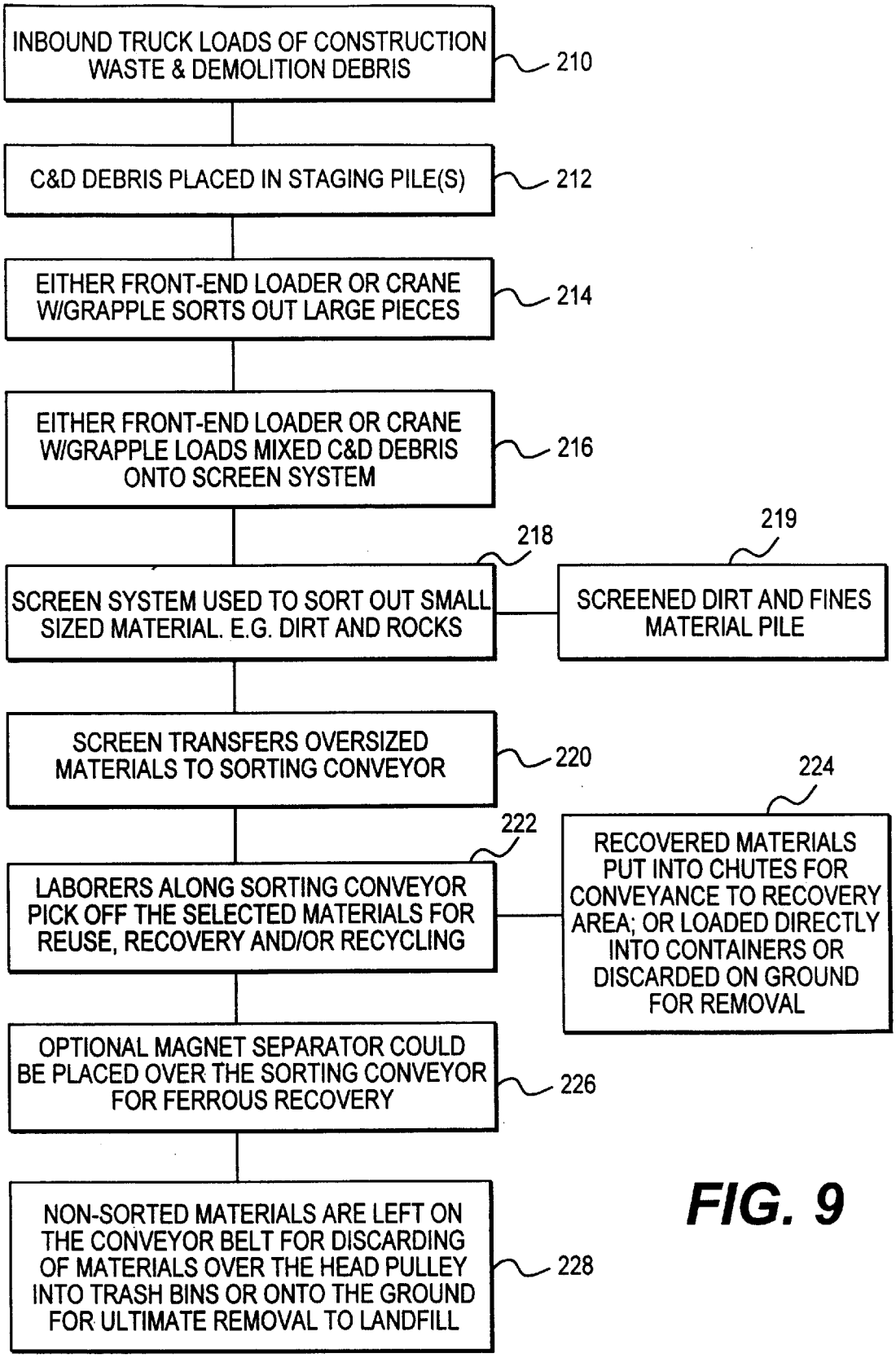
FIG. 9 is a flowchart illustrating a process of recovering materials from construction waste or demolition debris in accordance with the present invention.

The operation of the aforementioned device will now be described with reference to the drawings. A method 20 of recovering material from construction waste or demolition debris is illustrated in the flowchart of FIG. 9. Although this method is preferably performed with a structural arrangement like that shown in FIGS. 1–8, the method, in its broadest sense, could be performed with many different types of devices.

The material recovery process begins with the transport of a mobile construction waste and demolition debris recovery system 20 to a jobsite. It should be noted that the recovery system need not be physically located at the construction or demolition site. The recovery system may be positioned at a jobsite that is centrally located with respect to one or more construction or demolition locations and is serviced by trucks that transport waste or debris to the recovery system (step 210). In this manner, a single recovery system may be used to service multiple construction and/or demolition sites as well as multiple haulers that may service the sites.

Upon arrival at the jobsite, recovery system 20 is converted from the transport configuration to the operational configuration. First, retractable supports 58, shown in FIG. 1, are extended to contact the ground and locked with respect to wheeled chassis 21. The transporting vehicle may then be disengaged from the recovery system 20. Moveable end 57 of conveyor 46 is pivoted with respect to the remainder of the conveyor and into the operational position, shown in FIG. 8. Locking pin 142, shown in FIG. 8, is inserted into bracket 140 to secure the moveable end of the conveyor. Platforms 50 are pivoted about hinges 134 from their transport position above the conveyor 46 and into their operational position. Railings 52 are then engaged with brackets 138 and ladders 48 are attached to platforms 50. Prior to operation of grapple 22, retractable grapple support 72 is extended relative to chassis 21 and fixed with respect to sleeve 74 to further support and stabilize the recovery system.

Front end loaders or excavators present on the jobsite move construction waste and/or demolition debris into staging areas on the ground around the recovery system (step 212). Large pieces of waste and/or debris and un-recoverable material are removed from the staging piles by either grapple 22 or a separate front end loader (step 214).

A grapple operator then controls the motion of grapple 22 to move grapple bucket 27 to select waste and debris material for recovery processing (step 216). When bucket 27 is positioned to retrieve material, tongs 24 are closed around the material. Additionally, a separate front end loader or shovel may be used to aid in loading material onto screen 38.

The operator guides the grapple bucket 27 over screen 38 and slowly opens tongs 24 to drop the material onto the screen 38. Angled walls 40 guide the material onto screen 38. Preferably, the operator feathers the waste and debris material onto the screen 38 in a controlled fashion to provide a substantially constant flow of material.

As the motion of projections 132 on discs 42 moves the waste and debris material across screen 38, the smaller particles, or fines, pass through the openings of the screen 38 and larger, oversized materials continue along the top of screen 38 (step 218). The smaller particles, or fines, drop onto fines conveyor 90, shown in FIGS. 5 and 6, or are collected in bin 104 (step 219). The fines can then be used as a soil-like product or transported to a landfill or other appropriate destination. Preferably, the screening will achieve the separation of particles having their largest dimension averaging less than about one inch.

The mixed construction waste and demolition debris that is larger than the screen openings will ride over the top of screen 38 and drop off of the screen 38 onto the sorting conveyor 46 (step 220). The motion of the screen 38 provides the added benefit of mixing the waste and debris material and generating a uniform flow of material free of dirt-like fines. Once the mixed construction waste and demolition debris has been discharged onto sorting conveyor 46, the material is transferred horizontally where laborers positioned at picking stations 98 hand pick, or sort through, the material to manually remove any materials that may be valuable to the operation for reuse, recovery or recycling (step 222). The speed of the conveyor 46 may be adjusted to meet the needs of the laborers, depending on the amount of material entering the conveyor 46 and the types of materials that are being recovered.

As the laborers select materials from the waste stream for further processing, those materials are dropped down chutes along the side of the sorting conveyor 46 to keep the same types of materials in concentrated batches (step 224). Additionally, if certain materials are too large for the chute, or appear too infrequently to justify using one of the system's chutes, laborers may place these materials in small containers or barrels that are located on the sorting level alongside the recovery system. Alternatively, these large or rare materials may be piled on the ground next to the recovery system.

In addition to the manual removal of selected materials, a magnetic separator may be suspended over the sorting conveyor to mechanically remove ferrous materials from sorting conveyor 46 (step 226). Non-selected materials, including non-magnetic materials, that are not removed from the sorting conveyor 46 continue along the conveyor 46 and are ultimately dropped onto the ground or into containers or trailers after they pass over the head pulley on conveyor 46 (step 228).

After all construction waste and demolition debris has been processed, the recovery system is converted back to the transport configuration. Hinged end 57 of conveyor 46 is unlocked and pivoted over the top of the remainder of the conveyor 46. Grapple 22 is lowered to rest against screen 38 and conveyor 46. Railings 52 are removed from platforms 50 and the platforms are pivoted over the top of the conveyor 46. All moveable parts are secured to the recovery system to prevent damage during transport. When the system is configured as a trailer, the system is then hitched to truck or other transport vehicle and retractable supports 58 and 72 are retracted. The recovery system may then be transported to another location to process additional construction waste and demolition debris. When the system is configured as a trailer, the system is then hitched to truck or other transport vehicle and retractable supports 58 and 72 are retracted. The recovery system may then be transported to another location to process additional construction waste and demolition debris.

It will be apparent to those skilled in the art that various modifications and variations can be made in the structure and methodology of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mobile system for recovering materials from at least one of construction waste and demolition debris, the system comprising:

a mobile wheeled chassis having at least one picking station;

a grapple mounted on the wheeled chassis for selectively loading at least one of the screen disposed on the wheeled chassis and being configured to receive said at least one of waste and debris from the grapple and to sort said at least one of waste and debris into fines and oversized material; and a conveyor configured to transport the oversized material adjacent to at least one picking station to allow selected materials to be removed for further processing.

2. The system of claim 1, wherein a first plurality of picking stations are disposed on a first side of the conveyor and a second plurality of picking stations are disposed on a second side of the conveyor.

3. The system of claim 2, further comprising a first platform configured to provide support for an operator located at one of the first plurality of picking stations and a second platform configured to provide support for an operator located at one of the second plurality of picking stations.

4. The system of claim 3, wherein each of the first and second platforms includes a hinge to allow each of the first and second platforms to be raised into a transport position where each of the first and second platforms is positioned over the conveyor.

5. The system of claim 3, further comprising safety rails engageable with the first and second platforms and at least one ladder selectively engageable with at least one of the first and second platforms.

6. The system of claim 1, further comprising a magnetic separator disposed adjacent the conveyor to further separate the debris into magnetic and non-magnetic materials.

7. The system of claim 1, wherein the screen is a disc screen including a series of rotatable discs having projections.

8. The system of claim 1, further comprising a chute disposed beneath said screen, the chute being operable to guide the fines onto a fines conveyor operable to transport the fines to a side of the wheeled chassis.

9. The system of claim 8, further comprising a bin configured to receive the fines.

10. The system of claim 1, wherein the grapple includes a bucket operable to open and close to selectively retrieve said at least one of waste and debris from the jobsite.

11. The system of claim 1, wherein one end of the conveyor includes a hinge separating the conveyor into a hinged portion and a stationary portion, the hinged end being moveable between an operational position where the hinged end is substantially aligned with the stationary portion and transport position where the hinged end is raised relative to the stationary portion.

12. The system of claim 1, wherein the mobile wheeled chassis is configured in the form of a trailer.

13. The system of claim 1, wherein a feeder is disposed adjacent the screen to receive said at least one of waste and debris from the grapple.

14. The system of claim 13, wherein the feeder is tilted relative to the screen to cause the waste or debris to slide onto the screen.

15. The system of claim 1, wherein the screen is a finger screen.

16. A mobile system for recovering materials from at least one of construction waste and demolition debris, the system comprising:

a mobile wheeled chassis having at least one picking station;

a loading means, disposed on the wheeled chassis, for selectively loading at least one of waste and debris from a construction site directly onto a sorting means;

the sorting means, disposed on the wheeled chassis, for sorting said at least one of waste and debris into fines and oversized material; and conveying means for transporting the oversized material adjacent to at least one picking station to allow selected materials to be removed for further processing.

17. The system of claim 16, wherein the sorting means is a vibrating feeder.

18. A method of recovering materials from at least one of construction waste and demolition debris, comprising:

providing a grapple disposed on a mobile wheeled chassis;

loading at least one of construction waste and demolition debris with the grapple directly onto a screen disposed on the mobile wheeled chassis;

sorting said at least one of waste and debris into fines and oversized material with the screen;

conveying said oversized material adjacent to at least one picking station; and removing selected recoverable materials from the oversized material for further processing.

19. The method of claim 18, further comprising sorting the fines into small particles and large particles.

20. The method of claim 18, further comprising magnetically separating the oversized material into magnetic and non-magnetic materials.

21. The method of claim 18, further comprising conveying the non-selected oversized material to a container.

22. The method of claim 18, further comprising transporting the wheeled chassis to a jobsite.

* * * * *

UNITED STATES PATENT AND TRADEMARK OFFICE

CERTIFICATE OF CORRECTION

PATENT NO. : 6,382,425 B1
DATED : May 7, 2002
INVENTOR(S) : Robert H. Brickner et al.

It is certified that error appears in the above-identified patent and that said Letters Patent is hereby corrected as shown below:

Column 10,
Line 54, after "one of" insert -- waste and debris from a jobsite directly onto a screen; --.

Signed and Sealed this

Tenth Day of September, 2002

*Attest:*

*Attesting Officer*

JAMES E. ROGAN
*Director of the United States Patent and Trademark Office*